US008147352B2

(12) United States Patent
Lee et al.

(10) Patent No.: US 8,147,352 B2
(45) Date of Patent: Apr. 3, 2012

(54) GOLF CLUB HAVING HYDROPHOBIC AND HYDROPHILIC PORTIONS

(75) Inventors: David S. Lee, Wenham, MA (US); John Thomas Stites, Weatherford, TX (US)

(73) Assignee: Nike, Inc., Beaverton, OR (US)

( * ) Notice: Subject to any disclaimer, the term of this patent is extended or adjusted under 35 U.S.C. 154(b) by 144 days.

(21) Appl. No.: 12/421,744

(22) Filed: Apr. 10, 2009

(65) Prior Publication Data

US 2010/0261538 A1 Oct. 14, 2010

(51) Int. Cl.
*A63B 53/04* (2006.01)

(52) U.S. Cl. ..... 473/331; 473/330; 473/324

(58) Field of Classification Search ..... 473/324, 473/331, 330

See application file for complete search history.

(56) References Cited

U.S. PATENT DOCUMENTS

| | | | | |
|---|---|---|---|---|
| 3,965,955 | A * | 6/1976 | Price | 150/160 |
| 4,768,787 | A * | 9/1988 | Shira | 473/331 |
| 4,964,641 | A * | 10/1990 | Miesch et al. | 473/330 |
| 5,358,249 | A * | 10/1994 | Mendralla | 473/331 |
| 5,647,808 | A * | 7/1997 | Hosokawa | 473/349 |
| 5,885,171 | A * | 3/1999 | Sharpe | 473/330 |
| 6,270,424 | B1 | 8/2001 | Holub | |
| 6,372,323 | B1 * | 4/2002 | Kobe et al. | 428/119 |
| 7,368,163 | B2 | 5/2008 | Huang et al. | |
| 7,387,765 | B2 | 6/2008 | Chen et al. | |
| 7,442,556 | B2 | 10/2008 | Manger et al. | |
| 7,749,099 | B2 * | 7/2010 | Ban et al. | 473/331 |
| 7,922,601 | B2 * | 4/2011 | Ban et al. | 473/330 |
| 7,976,404 | B2 * | 7/2011 | Golden et al. | 473/330 |
| 2003/0186035 | A1 * | 10/2003 | Cruce et al. | 428/292.4 |
| 2005/0209020 | A1 * | 9/2005 | Burrows | 473/330 |
| 2007/0178988 | A1 * | 8/2007 | Tavares et al. | 473/334 |
| 2009/0197700 | A1 * | 8/2009 | Ban et al. | 473/331 |
| 2009/0318243 | A1 * | 12/2009 | Golden et al. | 473/331 |
| 2010/0035703 | A1 * | 2/2010 | Ishikawa et al. | 473/340 |
| 2010/0056295 | A1 * | 3/2010 | Ban et al. | 473/331 |
| 2010/0087270 | A1 * | 4/2010 | Ban et al. | 473/331 |
| 2010/0175797 | A1 * | 7/2010 | Dowling | 150/160 |

FOREIGN PATENT DOCUMENTS

EP 0743080 A 11/1996

(Continued)

OTHER PUBLICATIONS

Simpson, John and D'Urso, Brian R. (researchers, Engineering Science & Technology Division), Presentation at IAC Meeting by John T. Simpson, Ph.D., Feb. 1, 2007, "Superhydrophobic and Nanostructured Materials, A Different Type of Nanotechnology" (Oak Ridge National Laboratory, U.S. Department of Energy) 33 pages.

(Continued)

*Primary Examiner* — Stephen L. Blau
(74) *Attorney, Agent, or Firm* — Banner & Witcoff, Ltd.

(57) ABSTRACT

A golf club or component thereof has a surface, wherein at least one area of the surface has a level of hydrophilicity which is less than the level of hydrophilicity in at least one surrounding portion, causing moisture to be preferentially attracted to the surrounding portion. In one aspect, the surface is a striking face and the surrounding portion is one or more grooves formed in the striking face. In another aspect, the surface is a grip and the surrounding portion is one or more channels formed in the grip. In some examples, hydrophobic or superhydrophobic surfaces on golf club components repel water and, in some instances, also offer self-cleaning functionality.

6 Claims, 4 Drawing Sheets

FOREIGN PATENT DOCUMENTS

| | | | | |
|---|---|---|---|---|
| EP | 0960635 | A2 | | 12/1999 |
| JP | 02021882 | A | * | 1/1990 |
| JP | 6114129 | A | | 4/1994 |
| JP | 10314346 | A | | 12/1998 |
| JP | 2009153921 | A | | 7/2009 |

OTHER PUBLICATIONS

Annex to Form PCT/ISA/206 Communication Relating to the Results of the Partial International Search mailed Aug. 5, 2010 for PCT/US2010/029788.

* cited by examiner

GOLF CLUB HAVING HYDROPHOBIC AND HYDROPHILIC PORTIONS

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g. golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also is available on the market that promises to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.). Also, individual club head models may include multiple variations, such as variations in the loft angle, lie angle, offset features, weighting characteristics (e.g., draw biased club heads, fade biased club heads, neutrally weighted club heads, etc.). Club heads may be combined with a variety of different shafts, e.g. from different manufacturers; having different stiffnesses, flex points, kick points, or other flexion characteristics, etc.; made from different materials; etc.). Between the available variations in shafts and club heads, there are literally hundreds of different club head/shaft combinations available to the golfer.

The grooves on the face of a golf club can have a significant effect on ball flight. Different groove geometries can lead to differences in the amount of spin, velocity, and trajectory of the ball after impact with the face. The presence of dirt, grass, sand, and/or water on the club face can interfere with the intended impact between the ball and club face. Deeper and/or wider grooves can accommodate greater amounts of foreign matter, e.g., water, grass, etc. The grooves can keep foreign matter away from the face of the golf club and allow the face to interact more cleanly with the ball on impact. However, rules governing golf club design have limited the ability to systematically improve groove design.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention are directed to golf clubs or individual components thereof, such as golf club heads, grips, and the like. In one aspect, a golf club or component thereof has a surface wherein at least one area of the surface has a level of hydrophilicity which is less than the level of hydrophilicity in at least one surrounding portion. The higher level of hydrophilicity in the surrounding portion(s) causes moisture to be preferentially attracted to the surrounding portion(s), e.g., away from the surface. In one aspect, the surface is a striking face and the surrounding portion comprises one or more grooves in the striking face. In another aspect, the surface is a grip and the surrounding portion comprises one or more channels formed in or surrounding to the grip. In yet another aspect, the surface is a portion of a striking face, and the surrounding portion comprises multiple surrounding areas with varying levels of hydrophilicity.

BRIEF DESCRIPTION OF THE DRAWINGS

A more complete understanding of the present invention and certain advantages thereof may be acquired by referring to the following detailed description in consideration with the accompanying drawings, in which.

The reader is advised that the attached drawings are not necessarily drawn to scale.

DETAILED DESCRIPTION

In the following description of various example structures, reference is made to the accompanying drawings, which form a part hereof, and in which are shown by way of illustration various example connection assemblies, golf club heads, and golf club structures. Additionally, it is to be understood that other specific arrangements of parts and structures may be utilized and structural and functional modifications may be made without departing from the scope of the present invention. Also, while terms such as "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures.

Figure 1:
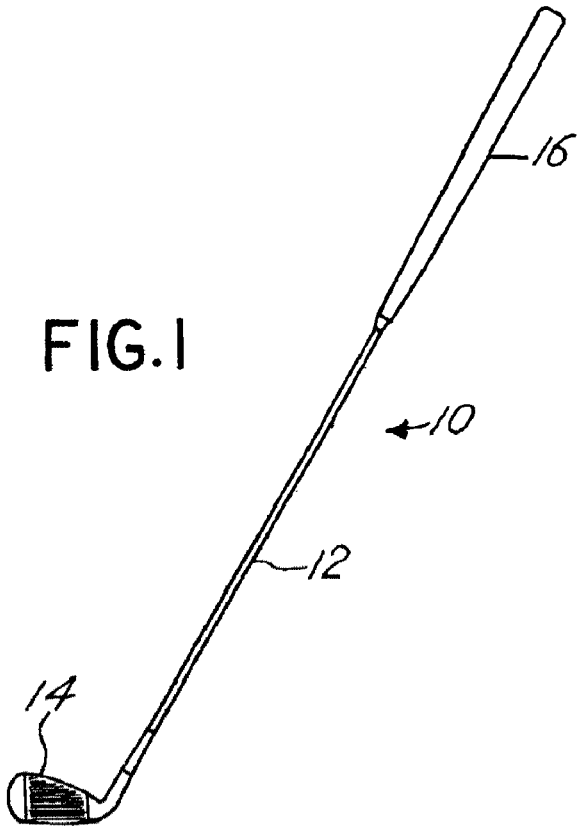
FIG. 1 is a perspective view of a golf club.

Referring to FIG. 1, a golf club 10 typically includes a shaft 12 and a golf club head 14. The golf club head 14 of FIG. 1 may be representative of a two iron golf club head. Such an iron is shown for illustrative purposes only, as the features described herein may be used in combination with any type of golf club, non-limiting examples of which include drivers, fairway woods, fairway metals, hybrid clubs, irons, wedges, putters, and the like. The shaft 12 of the golf club 10 may be made of various materials such as steel, titanium, graphite, or a composite material. A grip 16 is positioned on the shaft 12 to provide a golfer with a slip resistant surface on which to grasp the golf club 10.

Figure 2:
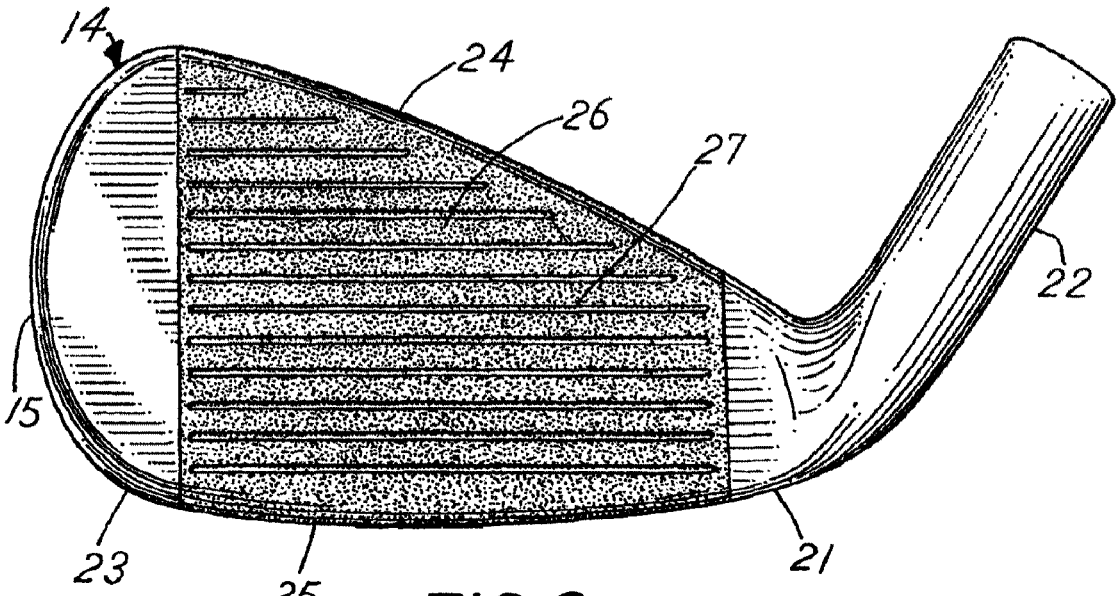
FIG. 2 is a front view of a golf club face having a plurality of horizontal grooves.

As shown in FIG. 2, the golf club head 14 comprises a body 15 that includes a heel 21 and a toe 23. The heel 21 is attached to a hosel 22 for connecting the shaft 12 of FIG. 1 to the golf club head 14. The body 15 also includes a top portion 24 and a sole portion 25. A striking face 26 is connected between the top portion 24 and the sole portion 25, and between the toe 23 and the heel 21. The striking face 26 provides a contact area for engaging and propelling a golf ball in an intended direction. The striking face 26 may have a plurality of grooves 27 extending between the toe and heel. The body 15 of golf club head 14 may be constructed of various materials such as steel, titanium, aluminum, tungsten, graphite, polymers, or composites.

The grip member 16 may be engaged with the shaft 12 in any desired manner, including in conventional manners that are known and used in the art (e.g. via cements or adhesives, via mechanical connections, etc.). Any desired materials may be used for the grip member 16, including conventional materials that are known and used in the art, such as rubber, polymeric materials, cork, rubber or polymeric materials with cord or other fabric elements embedded therein, cloth or fabric, tape, etc. Optionally, the grip member 16 may be releasably connected to the shaft 12 using a releasable connection.

According to one aspect, one or more surfaces of the golf club 10 has a level of hydrophilicity which is less than the level of hydrophilicity in one or more surrounding portions. As a result, moisture is attracted to the surrounding portions, e.g., away from the surface of lower hydrophilicity. The surrounding portion or portions may be in grooves, channels, recessed portions, etc. interspersed with the surface. For example, in the golf club head shown in FIG. 2, the surface having a lower level of hydrophilicity may be the striking face 26, and the surrounding portions having a higher level of hydrophilicity may be the horizontal grooves 27 traversing the striking face 26. It should be understood that not all surrounding portions need have a relatively higher level of hydrophilicity, for example one or more surrounding portions may have a level of hydrophilicity which is the same as that of the surface.

Figure 4:
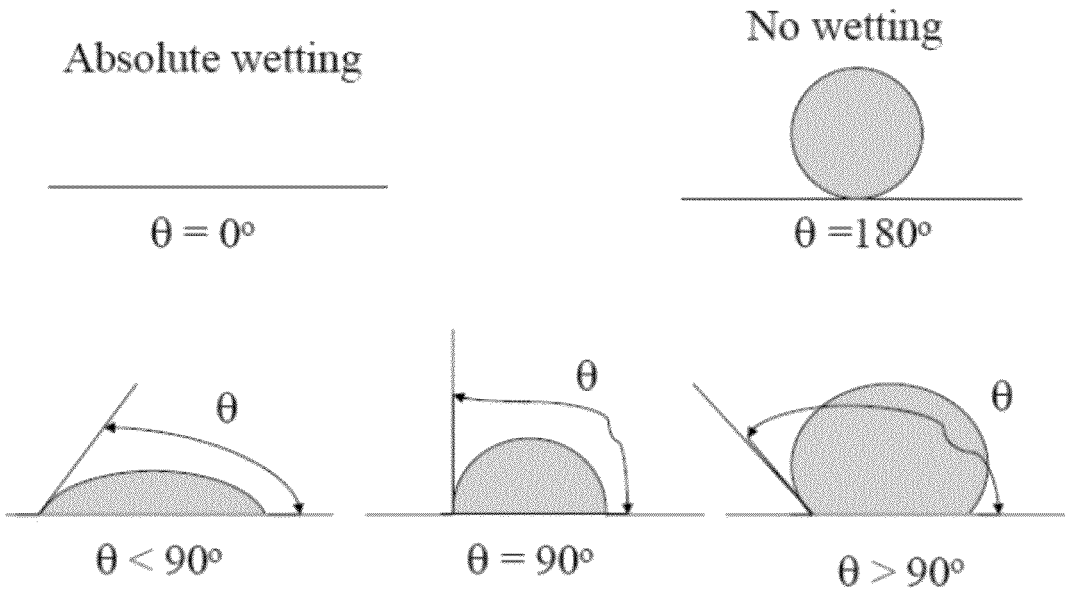
FIG. 4 is an illustration of contact angles between surfaces and water that may be used to quantify whether the surface is hydrophilic or hydrophobic.

With reference to FIG. 4, a surface that makes a contact angle with water ("θ") of less than 90° is considered hydrophilic. A surface that makes a contact angle with water ("θ") of more than 90° is considered hydrophobic. A surface that makes a contact angle with water ("θ") of more than about 150° is considered superhydrophobic. The term "hydrophobic," as used herein, is inclusive of surfaces that are considered superhydrophobic. The relative hydrophilicity of two surfaces can be determining by comparing the contact angles between the surfaces and water. For example, a surface that makes a contact angle with water of 60° is less hydrophilic than a surface that makes a contact angle with water of 30°. The surface and surrounding portion, as described herein, may be hydrophobic and hydrophilic, respectively. Alternatively, the surface and surrounding portion may be weakly hydrophilic and more strongly hydrophilic, respectively. The difference in contact angle with water (θ) between that of the surface and that of the surrounding portion is usually at least about 5° and often ranges from about 10° to about 150°, more usually from about 25° to about 125° or from about 40° to about 100°.

As another example of surrounding portions being interspersed with a surface, the surface may have small pores that are capable of drawing moisture. The pores may be provided, for example, by using a metal foam having small open-celled porosity. The inside surfaces of the pores may be coated with a hydrophilic compound to promote a "wicking" action of moisture away from the surface. Open-celled metal foams, often constructed from aluminum, have a structure similar to open-celled polyurethane foams and have been used in aerospace and other industries.

Instead of being interspersed with the surface, the portion of greater hydrophilicity may be otherwise located in close proximity to the surface. As described herein, the surrounding portion of greater hydrophilicity is in sufficiently close proximity to enable moisture present on the surface to be attracted (at least to some extent) to the hydrophilic portion. For example, a portion of greater hydrophilicity may surround or partially surround the perimeter of the striking face 26 in the golf club head shown in FIG. 2. Although the portion of greater hydrophilicity is illustrated in the drawings in grooves or recessed areas, it should be understood that the invention is not so limited. The portion(s) of greater hydrophilicity may be coplanar or otherwise coextensive with the surface of lower hydrophilicity, or in some cases may project from the surface. As another example, portion(s) of greater hydrophilicity may be on inside surface(s) of a head cover. This way, moisture present on the club head or portion(s) thereof may be drawn toward the portion(s) of greater hydrophilicity on the inside surface(s) of the head cover to facilitate drying of the club head.

Figure 3:
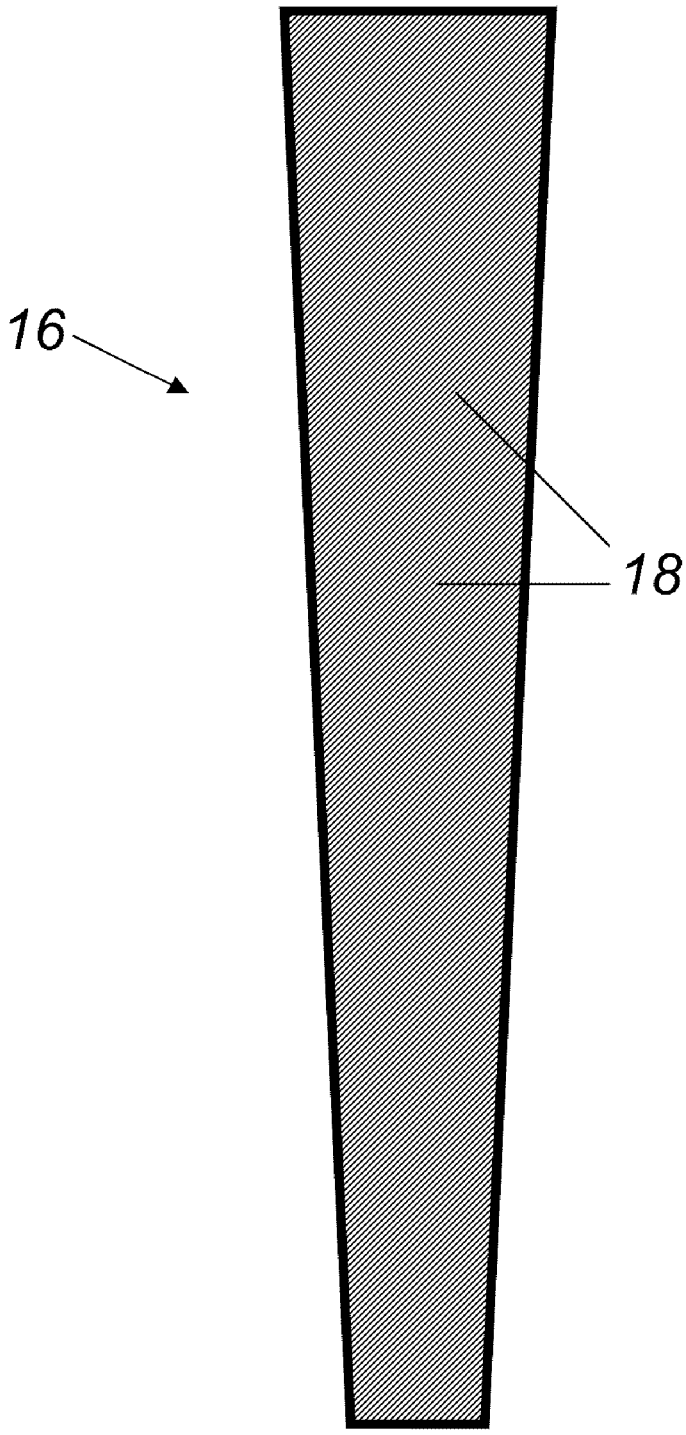
FIG. 3 is a front view of a golf club grip.

While the hydrophilic surface has been described above in conjunction with a striking face 26 of a golf club 10, it should be understood that one or more portions of relatively high hydrophilicity may be provided in one or more other regions of a golf club where it may be desirable to preferentially attract moisture away from a surface. For example, as in the embodiment shown in FIG. 3, the grip member 16 may be provided with a plurality of fine grooves 18 that have a greater level of hydrophilicity than that of the outer surface of the grip member 16. This way, moisture is attracted into the fine grooves 18 and away from the outer surface of the grip member 16, making it less likely that the grip member 16 will slip in a golfer's hands. Instead of providing grooves 18, a hydrophilic portion may be provided in the form of a band or bands surrounding the shaft 12 and/or grip member 16. As another example, the lower leading edge of a golf club face may have a hydrophobic portion. This may be particularly beneficial for clubs, such as wedges, that are more likely to be used for ball striking in rough, wet grass conditions. It also may be beneficial to have a strongly hydrophobic surface on the striking face of a putter to draw moisture away, thereby helping to improve putting accuracy. As yet another example, the upper surface of a driver or fairway metal type club may have a hydrophobic surface for repelling moisture for aesthetic purposes.

A variety of techniques may be used to create different levels of hydrophilicity between the surface and the surrounding portion(s), so that moisture is preferentially attracted to the surrounding portion(s) of higher hydrophilicity. In one aspect, materials having different levels of hydrophilicity may be used to construct the surface and the surrounding portion(s). For example, the striking face 26 may be constructed of metal or other conventional materials, and the inside surfaces of the grooves 27 may be coated with a material, such as a metal or polymer which has a greater level of hydrophilicity than that of the striking face 26. Alternatively or additionally, the striking face 26 may be constructed from or coated with a hydrophobic material, rendering the grooves 27 more hydrophilic than the striking face 26. Polymers such as polypropylene and co-polyesters generally have a low surface-attractive force for water. Other non-limiting examples of hydrophobic materials include waxes, fluorinated polymers such as polytetrafluoroethylene, and the like. Hydrophobic and superhydrophobic coatings are commercially available, non-limiting examples of which include DURALON ($\theta$=118°, available from Cotec) and Fluorothane WX 2100 ($\theta$>150°) and Fluorothane GE ($\theta$>115°, both available from Cytonix).

In yet another aspect, techniques used in microfluidic chips for sampling biological fluids may be employed to form portions having different levels of hydrophilicity. Microfluidic chips generally have microchannels formed in a substrate constructed of quartz, glass, silicon, polymer, or the like to create regions of high interfacial energy and low interfacial energy. Non-limiting examples of microfluidic chip structures are described in U.S. Pat. Nos. 7,387,765 and 7,442,556, the disclosures of which are hereby incorporated by reference.

Yet other aspects involve chemical or physical surface modification to impart hydrophobicity or hydrophilicity. Some techniques involving covalently attaching a surface modifying compound to an organic or inorganic substrate require activation of the substrate surface. Alternatively, a polymer having an intrinsic reactive functional group on its surface may be used such that a surface modifying compound is covalently attached to the polymer surface without the need for a surface activation step. See, e.g., U.S. Pat. No. 7,368,163 to Huang et al., the disclosure of which is hereby incorporated by reference. Huang et al. describes a surface-modified polymer having a bulk polymer matrix with a reactive functional group dispersed therein and a polymeric surface covalently attached to a surface modifying compound. The surface modifying compound modifies the physical and/or chemical characteristics of the polymer surface and can be selected to give the modified polymer desired properties, such as hydrophilicity or hydrophobicity. In general, to increase the surface area coverage by a surface modifying compound, macromolecules with the desired functional groups are used. However, small molecules with the appropriate functional groups can also be used to achieve hydrophilicity.

As an example of physical surface modification, the inside surfaces of the grooves 27 may be physically modified using suitable machining techniques to create surface roughness. Fine surface roughness may increase the ability of the grooves 27 to wick moisture, by capillary action, away from the relatively smooth surface of the striking face 26.

Figure 5:
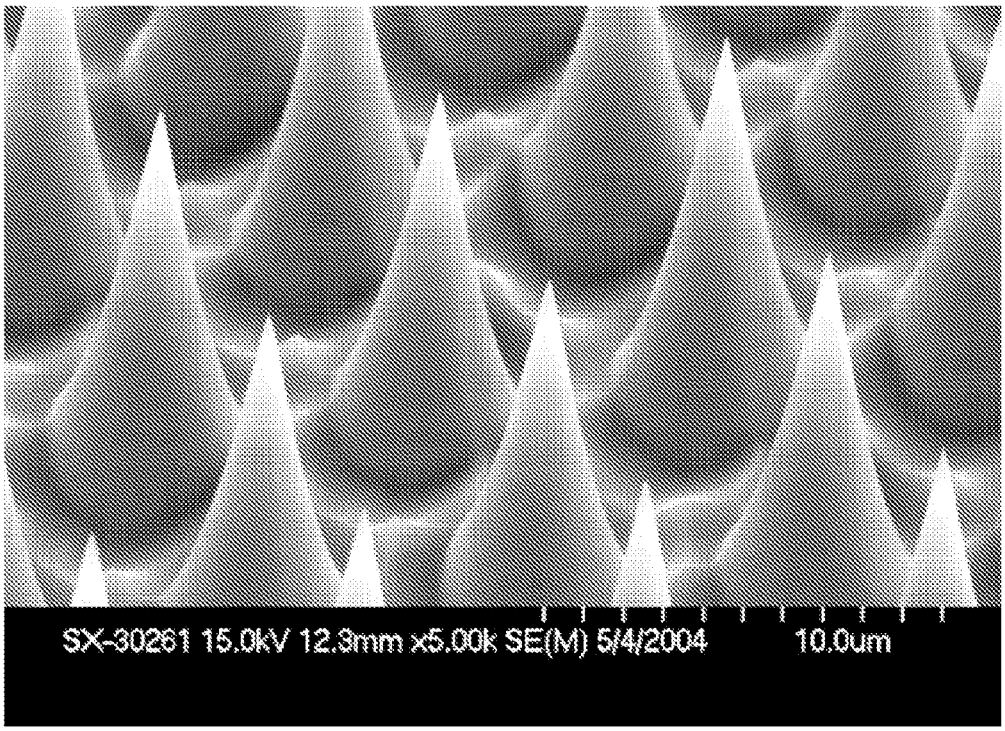
FIG. 5 is an illustration of a superhydrophobic surface having nano-sized spiked cones formed by etching nanochannels.

As another example of physical surface modification, a hydrophobic surface may be modified to increase its relative hydrophobicity. For example, superhydrophobic surfaces may be created as described in Simpson, "Superhydrophobic and Nano-structured Materials," IAC Meeting, University of Tennessee (February 2007). In general, nanochannels (e.g., diameter ≧17 nm) are formed in a substrate. The substrate is then sliced into wafers, and the nanochannels are etched to form spiked cones (e.g., >1 million cones/$cm^3$) as shown in FIG. 5. Using these techniques, superhydrophobic surfaces may be prepared that have contact angles with water ($\theta$) approaching 180°. In addition to the benefits of keeping surfaces dry and avoiding corrosion and the like, superhydrophobic surfaces may offer additional benefits such as being self-cleaning (e.g., debris present on the surface is easily removed as water is repelled from the surface). This may be particularly desirable, for example, on highly visible portions of golf clubs such as the upper surface of a driver or fairway metal club head, as well as other portions of golf clubs as described herein. For example, the nano-sized spiked cones may be formed on the striking face 26 of a golf club 14 as depicted in FIG. 2, which has a surrounding portion comprising a plurality of grooves 27 extending between the toe and heel, as previously described.

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A golf club head comprising a striking face surface and at least one surrounding portion comprising pores formed in a metal foam, wherein at least one area of the striking face surface has a level of hydrophilicity which is less than the level of hydrophilicity in the at least one surrounding portion, wherein the at least one surrounding portion comprises a hydrophilic polymer coated on inside surfaces of the pores, whereby moisture is preferentially attracted to the at least one surrounding portion.

2. The golf club head of claim 1 wherein the striking face surface, the at least one surrounding portion, or both, has a physically modified surface.

3. The golf club head of claim 1 wherein the at least one surrounding portion comprises a plurality of grooves traversing the striking face.

4. A golf club having an elongate shaft and a head positioned on an end of the shaft, wherein a striking face surface of the golf club has a level of hydrophilicity which is less than the level of hydrophilicity in at least one surrounding portion, wherein the at least one surrounding portion comprises pores formed in a metal foam and a hydrophilic polymer coated on inside surfaces of the pores, whereby moisture is preferentially attracted to the at least one surrounding portion.

5. The golf club of claim 4 wherein the striking face surface, the at least one surrounding portion, or both, has a physically modified surface.

6. A golf club having an elongate shaft and a head positioned on an end of the shaft, wherein the head comprises a striking face having a super-hydrophobic surface comprising a plurality of nano-sized spiked cones, and a plurality of grooves traversing the striking face, wherein the grooves are hydrophilic such that moisture is preferentially attracted to the grooves.

* * * * *